US009429156B2

(12) United States Patent
Seol et al.

(10) Patent No.: US 9,429,156 B2
(45) Date of Patent: Aug. 30, 2016

(54) COMPRESSOR

(71) Applicant: LG ELECTRONICS INC., Seoul (KR)

(72) Inventors: Seseok Seol, Seoul (KR); Bumdong Sa, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 14/141,713

(22) Filed: Dec. 27, 2013

(65) Prior Publication Data

US 2014/0186202 A1 Jul. 3, 2014

(30) Foreign Application Priority Data

Dec. 28, 2012 (KR) ..... 10-2012-0157218

(51) Int. Cl.
*F04C 23/00* (2006.01)
*F04C 15/00* (2006.01)
(Continued)

(52) U.S. Cl.
CPC ..... *F04C 15/0065* (2013.01); *F01C 21/08* (2013.01); *F04C 2/34* (2013.01); *F04C 15/0088* (2013.01); *F04C 18/045* (2013.01); *F04C 23/001* (2013.01); *F04C 23/008* (2013.01)

(58) Field of Classification Search
CPC ..... F04C 15/0065; F04C 15/0088; F04C 23/008; F04C 18/00; F04C 2/00; F04C 14/18; F01C 21/08; F01C 1/063; F16N 13/20
USPC ..... 418/29, 30, 55.5, 55.6, 59, 62, 63, 418/206.8; 417/410.2
See application file for complete search history.

(56) References Cited

U.S. PATENT DOCUMENTS 3,195,470 A 7/1965 Smith
5,102,316 A * 4/1992 Caillat ..... F01C 1/0215 418/55.5

(Continued)

FOREIGN PATENT DOCUMENTS

CN 1431403 7/2003
CN 1757921 4/2006

(Continued)

OTHER PUBLICATIONS

European Search Report issued in Application No. 13198325.6 dated Apr. 7, 2015.

(Continued)

*Primary Examiner* — Bryan Lettman
*Assistant Examiner* — David Brandt
(74) *Attorney, Agent, or Firm* — Ked & Associates, LLP

(57) ABSTRACT

A compressor is provided that may include a cylinder including an outer cylinder portion, an inner cylinder portion, and a vane portion connected between the outer cylinder portion and the inner cylinder portion, which is fixed to a casing. A rolling piston may be slidably coupled to the vane portion to form an outer compression space and an inner compression space while making a turning movement between the outer cylinder portion and the inner cylinder portion. Through this, a weight of a rotating body may be reduced to obtain a low power loss with respect to the same cooling power and a small bearing area, thereby reducing refrigerant leakage as well as easily changing a capacity of a cylinder in an expanded manner. In addition, refrigerant may be discharged in opposite directions to each other in each compression space, thereby reducing vibration noise of the compressor.

17 Claims, 15 Drawing Sheets

(51) Int. Cl.

| | |
|---|---|
| ***F01C 21/08*** | (2006.01) |
| ***F04C 18/04*** | (2006.01) |
| ***F04C 2/34*** | (2006.01) |

(56) References Cited

U.S. PATENT DOCUMENTS

| | | | | |
|---|---|---|---|---|
| 5,567,137 | A * | 10/1996 | Nakashima | F04C 29/02 418/100 |
| 5,897,306 | A * | 4/1999 | Beck | F04C 23/008 418/55.3 |
| 6,976,830 | B2 * | 12/2005 | Uchino | F04C 14/226 417/219 |
| 7,059,842 | B2 * | 6/2006 | Lee | F04C 18/3564 417/218 |
| 7,140,844 | B2 * | 11/2006 | Lee | F04C 28/22 417/218 |
| 7,153,109 | B2 * | 12/2006 | Cho | F04C 18/3564 417/218 |
| 7,534,100 | B2 * | 5/2009 | Masuda | F01C 21/08 418/59 |
| 8,172,560 | B2 * | 5/2012 | Masuda | F04C 18/045 418/270 |
| 8,323,009 | B2 * | 12/2012 | Shimizu | F04C 15/0042 418/11 |
| 8,419,395 | B2 * | 4/2013 | Furusho | F01C 1/045 418/107 |
| 8,905,734 | B2 * | 12/2014 | Shin | F01C 21/10 418/270 |
| 9,022,757 | B2 * | 5/2015 | Shin | F04C 18/322 418/270 |
| 2005/0220655 | A1 * | 10/2005 | Cho | F04C 18/324 418/139 |
| 2006/0073051 | A1 * | 4/2006 | Hwang | F04C 18/02 418/29 |
| 2006/0073053 | A1 * | 4/2006 | Hwang | F04C 18/02 418/29 |
| 2006/0073056 | A1 * | 4/2006 | Hwang | F04C 18/04 418/59 |
| 2006/0073058 | A1 * | 4/2006 | Hwang | F04C 18/04 418/59 |
| 2006/0127236 | A1 * | 6/2006 | Hwang | F04B 49/24 417/310 |
| 2006/0127256 | A1 * | 6/2006 | Hwang | F04C 18/04 418/29 |
| 2006/0127257 | A1 * | 6/2006 | Hwang | F04C 28/02 418/29 |
| 2006/0177334 | A1 * | 8/2006 | Hwang | F04C 18/02 418/55.5 |
| 2006/0177335 | A1 * | 8/2006 | Hwang | F04C 18/04 418/58 |
| 2006/0177337 | A1 * | 8/2006 | Hwang | F04C 29/028 418/59 |
| 2006/0177338 | A1 * | 8/2006 | Hwang | F04C 29/023 418/59 |
| 2006/0177339 | A1 * | 8/2006 | Hwang | F04C 29/025 418/59 |
| 2006/0198749 | A1 | 9/2006 | Hwang et al. | |
| 2006/0263225 | A1 * | 11/2006 | Ueda | F04C 27/005 418/55.5 |
| 2007/0059193 | A1 * | 3/2007 | Maladkar | F04C 18/0215 418/55.5 |
| 2007/0212246 | A1 * | 9/2007 | Jeong | F04C 18/0269 418/55.5 |
| 2007/0217936 | A1 * | 9/2007 | Oh | F04C 29/026 418/55.6 |
| 2008/0031756 | A1 * | 2/2008 | Hwang | F01C 21/0818 418/1 |
| 2008/0044305 | A1 * | 2/2008 | Hirayama | F04C 18/356 418/59 |
| 2008/0145252 | A1 * | 6/2008 | Ku | F04C 18/3442 418/54 |
| 2008/0159886 | A1 * | 7/2008 | Ku | F04C 18/0215 417/410.5 |
| 2008/0193310 | A1 * | 8/2008 | Byun | F01C 21/0863 418/23 |
| 2010/0017037 | A1 * | 1/2010 | Nam | F25B 49/025 700/275 |
| 2010/0189584 | A1 * | 7/2010 | Byun | A01N 43/08 418/13 |
| 2010/0319394 | A1 * | 12/2010 | Furusho | F01C 1/045 62/510 |
| 2010/0326128 | A1 * | 12/2010 | Sotojima | F04C 18/02 62/498 |
| 2011/0271699 | A1 * | 11/2011 | Lee | F04C 23/008 62/228.4 |
| 2012/0020819 | A1 * | 1/2012 | Han | F04B 39/0094 417/410.1 |
| 2013/0171017 | A1 * | 7/2013 | Park | F04C 23/008 418/55.5 |
| 2013/0251577 | A1 * | 9/2013 | Bush | F04C 23/008 418/55.5 |
| 2013/0302149 | A1 * | 11/2013 | Park | F04D 29/056 415/170.1 |
| 2014/0119969 | A1 * | 5/2014 | Iijima | F01C 21/106 418/30 |
| 2015/0192129 | A1 * | 7/2015 | Son | F04C 29/0042 417/349 |

FOREIGN PATENT DOCUMENTS

| | | | |
|---|---|---|---|
| CN | 1757923 | | 4/2006 |
| CN | 1789725 | | 6/2006 |
| CN | 100443727 | | 12/2008 |
| CN | 100467873 | | 3/2009 |
| CN | 102400916 | | 4/2012 |
| CN | 102597523 | | 7/2012 |
| CN | 102788019 | | 11/2012 |
| JP | 2008-111385 | A | 5/2008 |
| JP | 2009-108762 | | 5/2009 |
| KR | 2000-0061252 | A | 10/2000 |
| KR | 10-0614226 | | 8/2006 |
| KR | 10-2007-0032524 | | 3/2007 |
| KR | 10-0812934 | | 3/2008 |

OTHER PUBLICATIONS

European Search Report dated May 9, 2014 issued in foreign application No. 13199719.9.

Chinese Office Action dated Oct. 30, 2015. (English Translation).

Chinese Office Action dated Sep. 6, 2015 (English Translation).

U.S. Notice of Allowance issued in U.S. Appl. No. 14/141,651 dated Mar. 22, 2016.

* cited by examiner

COMPRESSOR

CROSS-REFERENCE TO RELATED APPLICATION(S)

This application claims priority to Korean Application No. 10-2012-0157218, filed in Korea on Dec. 28, 2012, which is herein expressly incorporated by reference in its entirety.

BACKGROUND

1. Field

A compressor is disclosed herein.

2. Background

In general, a compressor is applicable to a vapor compression type refrigeration cycle (hereinafter, abbreviated as a "refrigeration cycle"), such as a refrigerator, or air conditioner. For a refrigerant compressor, there has been introduced a constant speed compressor, which is driven at a predetermined speed, or an inverter type compressor, in which a rotation speed is controlled.

A compressor can be divided into a hermetic type compressor, in which an electric motor drive, which is a typical electric motor, and a compression unit or device operated by the electric drive are provided together at an inner space of a sealed casing, and an open type compressor in which an electric motor is separately provided outside of the casing. The hermetic compressor is mostly used for household or commercial refrigeration equipment.

The hermetic compressor may be divided into a single hermetic compressor and a multiple hermetic compressor according to a number of cylinders. The single hermetic compressor is provided with one cylinder having one compression space within the casing, whereas the multiple hermetic compressor is provided with a plurality of cylinders each having a compression space, respectively, within the casing.

The multiple hermetic compressor may be divided into a 1-suction, 2-discharge type and a 1-suction, 1-discharge type according to the refrigerant compression mode. The 1-suction, 1-discharge type is a compressor in which an accumulator is connected to a first cylinder among a plurality of cylinders through a first suction passage, and a second cylinder is connected to a discharge side of the first cylinder connected to the accumulator through a second suction passage, and thus, refrigerant is compressed by two stages and then discharged to an inner space of the casing. In contrast, the 1-suction, 2-discharge type is a compressor in which a plurality of cylinders are branched and connected to one suction pipe and refrigerant is compressed in the plurality of cylinders, respectively, and discharged to an inner space of the casing.

FIG. 1 is a longitudinal cross-sectional view of a related art 1-suction, 2-discharge type rotary compressor. As illustrated in the related art 1-suction, 2-discharge type rotary compressor, a motor drive 2 is provided within the casing 1, and a compressor unit or device 3 is provided at a lower side of the motor drive 2. The motor drive 2 and compressor unit 3 are mechanically connected through a crank shaft 23. Reference numerals 21 and 22 denote a stator and a rotor, respectively.

For the compressor unit 3, a main bearing 31 and a sub bearing 32 are fixed to the casing 1 at regular intervals to support the crank shaft 23, and a first cylinder 34 and a second cylinder 35 separated by an intermediate plate 33 are provided between the main bearing 31 and sub bearing 32.

An inlet port 33*a* connected to a suction pipe 11 is formed at or in the intermediate plate 33, and a first suction groove 33*b* and a second suction groove 33*c* that communicate with each compression space (V1, V2) of the first cylinder 34 and second cylinder 35 are formed at an end of the inlet port 33*a*.

A first eccentric portion 23*a* and a second eccentric portion 23*b* are formed on the crank shaft 23 along an axial direction with a distance of about 180° therebetween, and a first rolling piston 36 and a second rolling piston 37 to compress refrigerant are coupled to an outer circumferential surface of the first eccentric portion 23*a* and the second eccentric portion 23*b*, respectively. A first vane (not shown) and a second vane (not shown) welded to the first rolling piston 36 and the second rolling piston 37, respectively, to divide first compression space (V1) and second compression space (V2) into a suction chamber and a compression chamber, respectively, are coupled to the first cylinder 34 and the second cylinder 35. Reference numerals 5, 12, 31*a* and 32*a* denote an accumulator, a discharge pipe, and discharge ports, respectively.

According to the foregoing related art 1-suction, 2-discharge type rotary compressor, when power is applied to the motor drive 2 to rotate the rotor 22 and the crank shaft 23 of the motor drive 2, refrigerant is alternately inhaled into the first cylinder 34 and the second cylinder 35 while the first rolling piston 36 and the second rolling piston 37 revolve. The refrigerant is subjected to a series of processes of being discharged into an inner space of the casing 1 through the discharge ports 31*a*, 32*a* provided in the main bearing 31 and the sub bearing 32, respectively, while being compressed by the first vane of the first rolling piston 36 and the second vane of the second rolling piston 37.

However, according to the foregoing 1-suction, 2-discharge type rotary compressor, the first eccentric portion 23*a* and the second eccentric portion 23*b* are eccentrically formed at regular intervals with respect to an axial center in a lengthwise direction of the crank shaft 23, and thus, a moment due to an eccentric load is increased, thereby causing a problem of increasing vibration and friction loss of the compressor. Further, each vane is welded to each rolling piston 36, 37 to divide the suction chamber and the compression chamber, but according to operating conditions, refrigerant leakage is generated between each vane and each rolling piston 36, 37 while they are separated from each other, thereby reducing compressor efficiency.

Taking this into consideration, a 1-cylinder, 2-compression chamber type rotary compressor having two compression spaces in one cylinder has been introduced as disclosed in Korean Patent Registration No. 10-0812934. FIG. 2 is a longitudinal cross-sectional view of a related art 1-cylinder, 2-compression chamber type rotary compressor, and FIG. 3 is a transverse cross-sectional view of a cylinder and a piston in the 1-cylinder, 2-compression chamber type compressor of FIG. 2, taken along line "III-III" of FIG. 2.

As illustrated in FIG. 2, for a 1-cylinder, 2-compression chamber type rotary compressor (hereinafter, abbreviated as a "1-cylinder, 2-compression chamber compressor") according to the related art, a first compression space (V1) and a second compression space (V2) are formed at an outer side and an inner side of the piston 44, respectively. Further, the piston 44 is fixedly coupled to an upper housing 41 and casing 1, and the cylinder 43 is coupled in a sliding manner, between the upper housing 41 and lower housing 42, to eccentric portion 23*c* of crank shaft 23 so as to be revolved with respect to the piston 44.

A long hole-shaped inlet port 41*a* is formed at one side of the upper housing 41 to communicate with each suction chamber of the first compression space (V1) and the second compression space (V2), and a first discharge port 41*b* and a second discharge port 41*c* are formed at the other side of the upper housing 41 to communicate with each compression chamber of the first compression space (V1) and the second compression chamber V2 and the discharge space (S2).

As illustrated in FIG. 3, the cylinder 43 may include an outer cylinder portion 45 that forms the first compression space (V1), an inner cylinder portion 46 that forms the second compression space (V2), and a vane portion 47 that connects the outer cylinder portion 45 and the inner cylinder portion 46 to divide the suction chamber and the compression chamber. The outer cylinder portion 45 and the inner cylinder portion 46 are formed in a ring shape, and the vane portion 47 is formed in a vertically raised flat plate shape.

An inner diameter of the outer cylinder portion 45 is formed to be greater than an outer diameter of the piston 44, and an outer diameter of the inner cylinder portion 46 is formed to be less than an inner diameter of the piston 44, and thus, an inner circumferential surface of the outer cylinder portion 45 is brought into contact with an outer circumferential surface of the piston 44 at one point, and an outer circumferential surface of the inner cylinder portion 46 is brought into contact with an inner circumferential surface of the piston 44 at one point, thereby forming the first compression space (V1) and the second compression space (V2), respectively.

The piston 44 is formed in a ring shape, and a bush groove 49 is formed to allow the vane portion 47 of the cylinder 43 to be inserted thereinto in a sliding manner, and a rolling bush 48 is provided at or in the bush groove 45 to allow the piston 44 to make a turning movement. The rolling bush 48 is disposed such that flat surfaces of a semicircular suction side bush 48*a* and a discharge side bush 48*b* are brought into contact with the vane portion 47 at both sides thereof.

On the drawing, unexplained reference numerals 43*a* and 44*a* are lateral inlet ports.

According to the foregoing related art 1-cylinder, 2-compression chamber compressor, the cylinder 43 coupled to the crank shaft 23 makes a turning movement with respect to the piston 44 to alternately inhale refrigerant into the first compression space (V1) and the second compression space (V2), and the inhaled refrigerant is compressed by the outer cylinder portion 45, the inner cylinder portion 46, and the vane portion 47, and thus, alternately discharged into an inner space of the casing 1 through the first discharge port 41*b* and the second discharge port 41*c*.

As a result, the first compression space (V1) and the second compression space (V2) may be disposed adjacent to each other on the same plane, thereby reducing moment and friction loss. In addition, the vane portion 47, which divides the suction chamber and compression chamber, may be integrally coupled to the outer cylinder portion 45 and the inner cylinder portion 46, thereby enhancing sealability of the compression space.

However, according to the foregoing related art 1-cylinder, 2-compression chamber compressor, the piston 44 is fixed, but the relatively heavy cylinder 43 is rotated, and thus, a high power loss results with respect to the same cooling power and a large bearing area, thereby increasing concerns of refrigerant leakage.

Further, according to the related art 1-cylinder, 2-compression chamber compressor, part of an outer circumferential surface of the cylinder 43 may be closely adhered to an inner circumferential surface of the upper housing 41, and thus, a diameter of the upper housing 41 should be increased to change a volume of the cylinder 43 according to turning movement, and consequently, the casing 1 itself should be changed in an increasing manner, thereby causing a problem in which volume control of the compressor is not so easy.

Furthermore, according to the related art 1-cylinder, 2-compression chamber compressor, the first discharge port 41*b* and the second discharge port 41*c* may be formed to extend in the same direction, and thus, refrigerant being discharged first may lead to a so-called pulsation phenomenon, thereby aggravating vibration noise of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
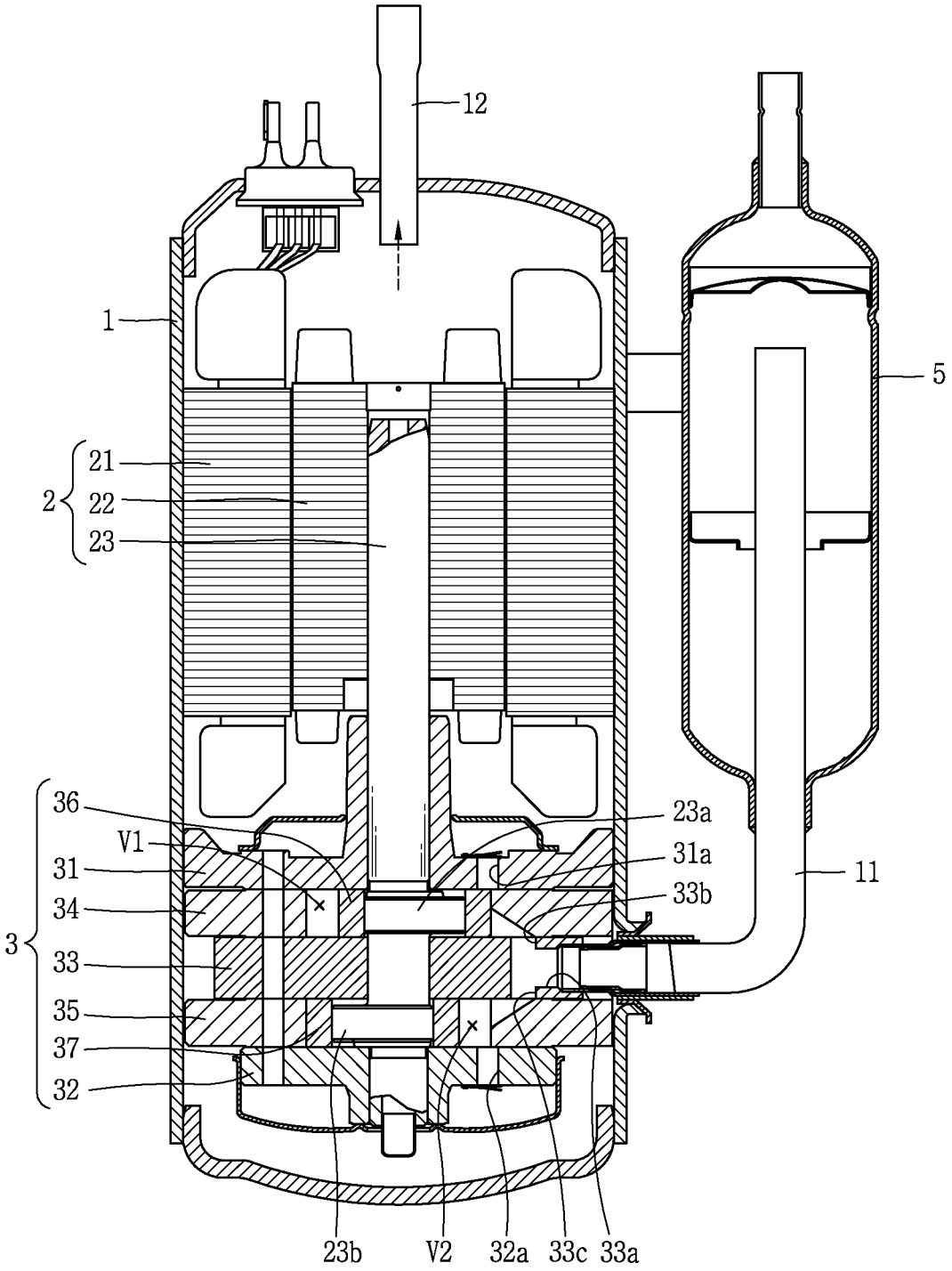
FIG. 1 RELATED ART
FIG. 1 is a longitudinal cross-sectional view of a related art 1-suction, 2-discharge type rotary compressor.
Figure 2:
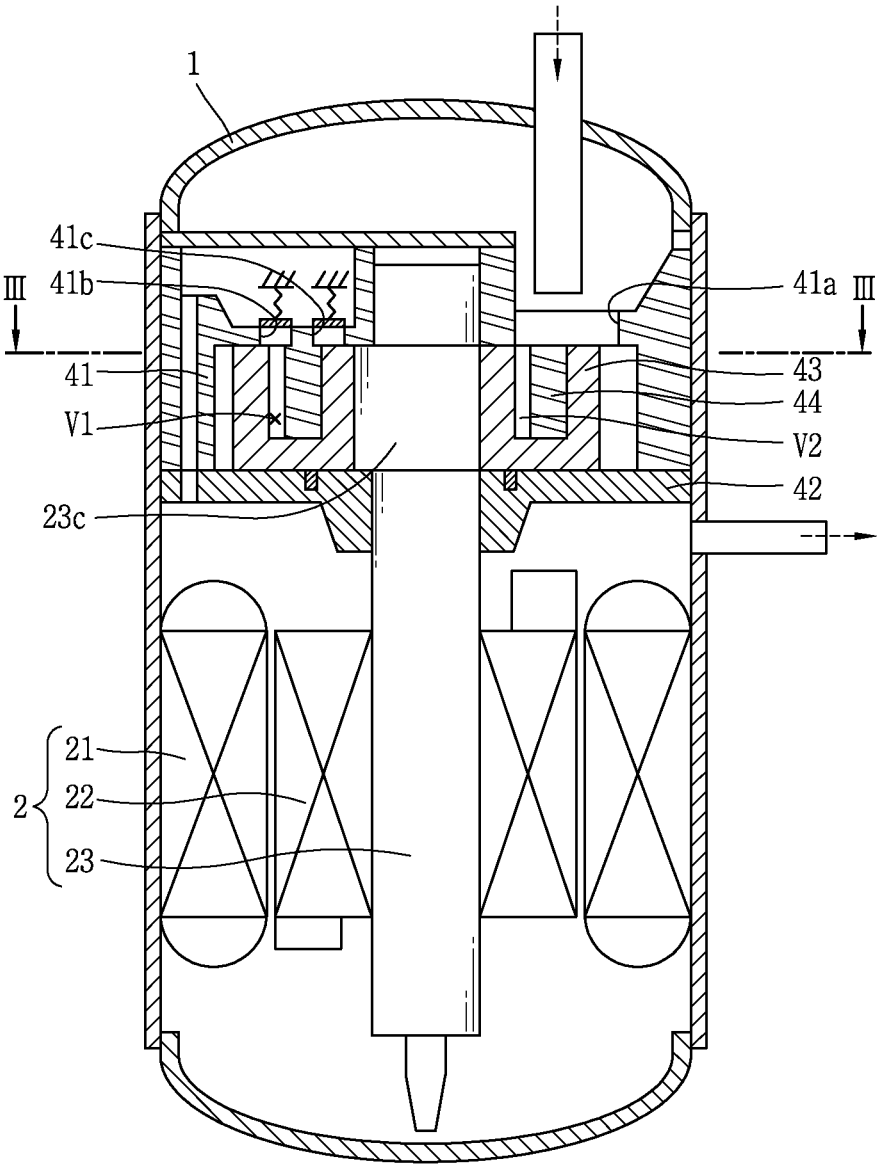
FIG. 2 PRIOR ART
FIG. 2 is a longitudinal cross-sectional view of a related art 1-cylinder 2-compression chamber type rotary compressor.
Figure 3:
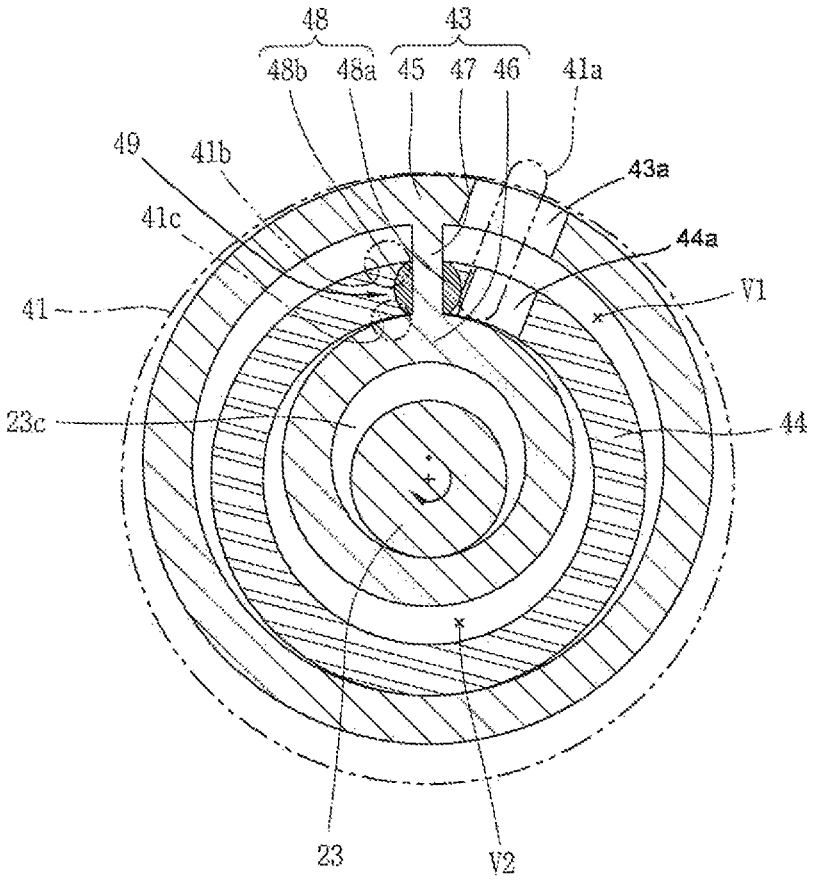
FIG. 3 RELATED ART
FIG. 3 is a transverse cross-sectional view of a cylinder and a piston, taken along line "III-III" of FIG. 2.

Hereinafter, a compressor according to embodiments will be described in detail with reference to the accompanying drawings. Where possible, like reference numerals have been used to indicate like elements, and repetitive disclosure has been omitted.

Figure 4:
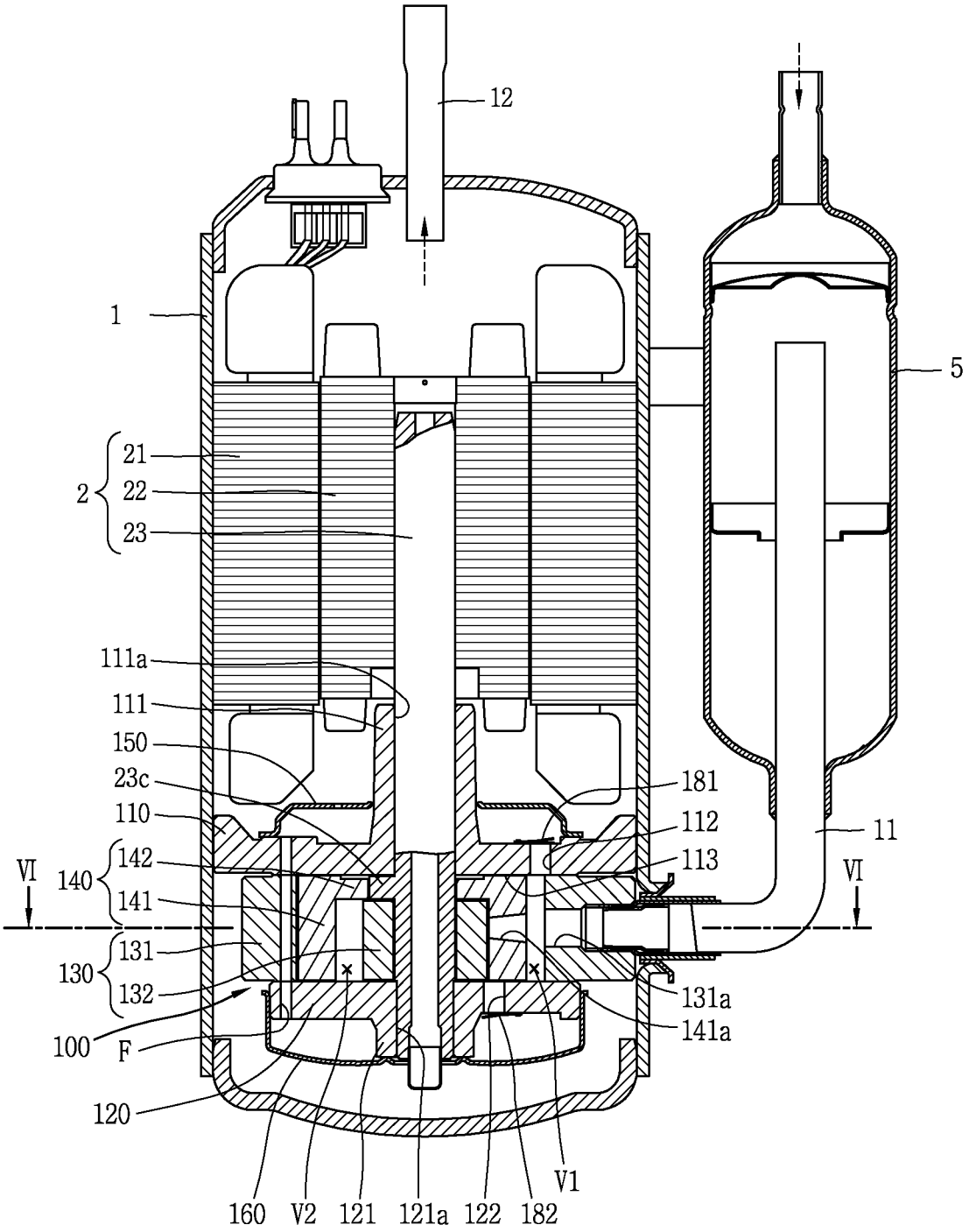
FIG. 4 is a longitudinal cross-sectional view of a 1-cylinder, 2-compression chamber type rotary compressor according to an embodiment.
Figure 5:
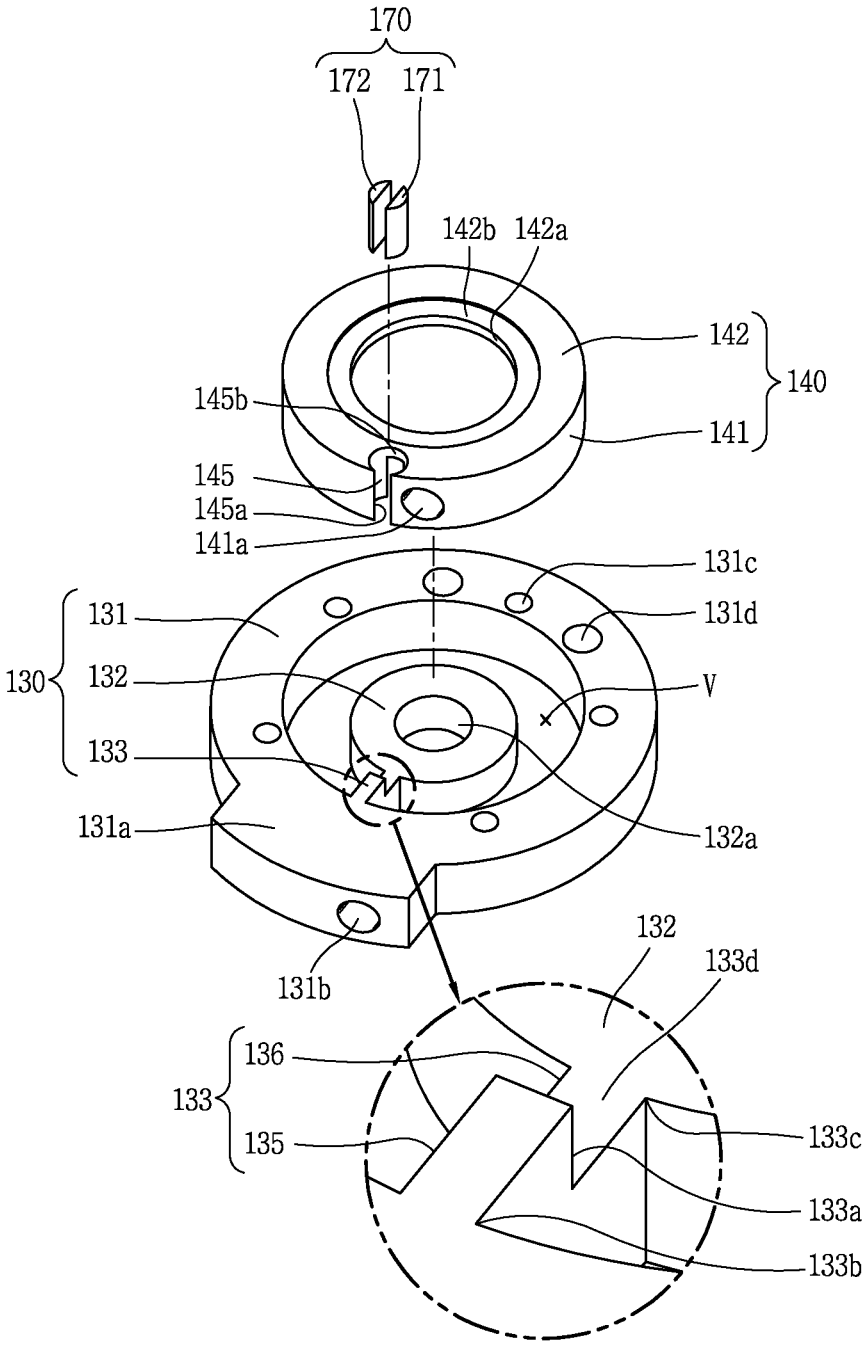
FIG. 5 is an exploded perspective view of a compression device in the compressor of FIG. 4.
Figure 6:
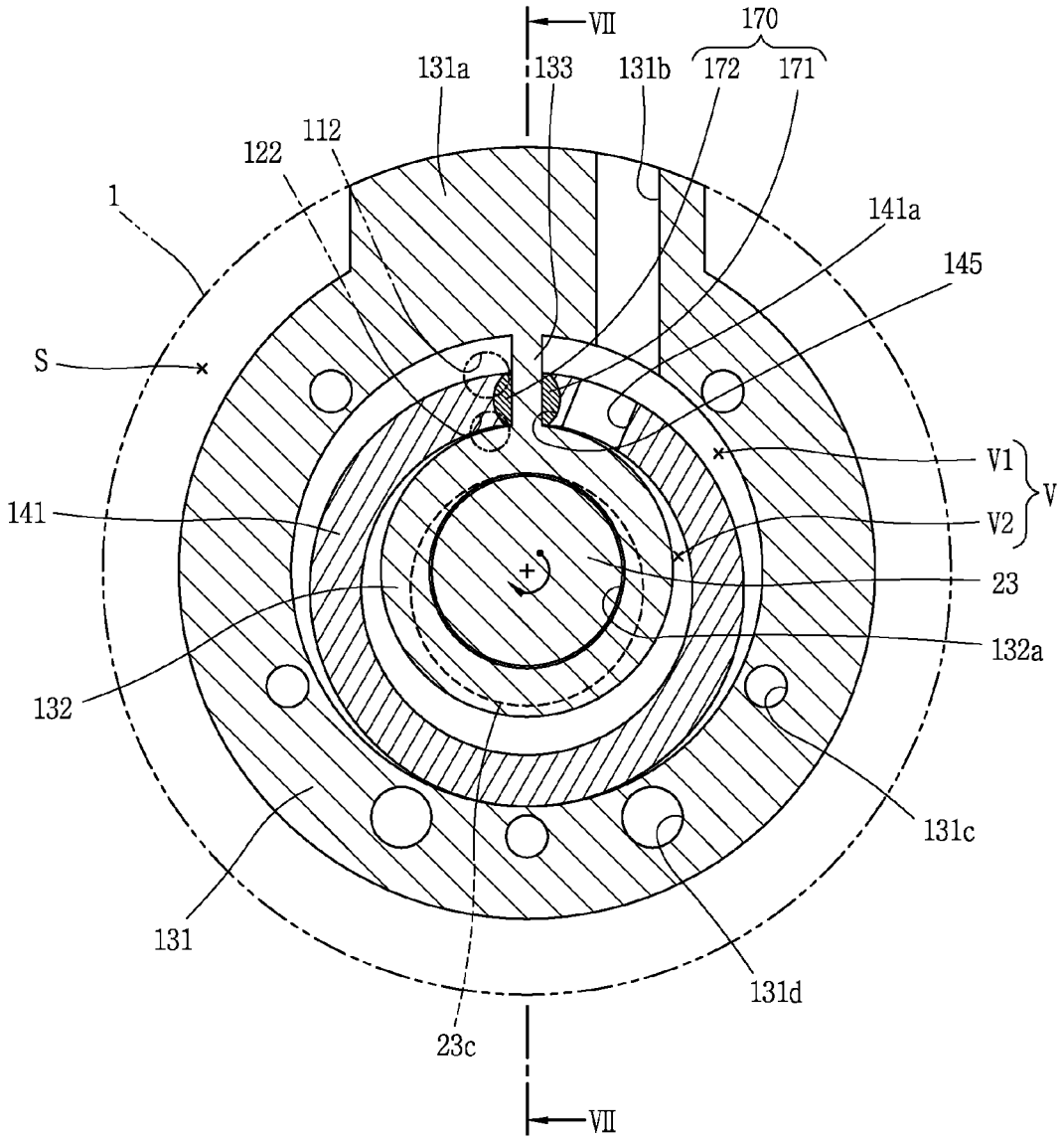
FIG. 6 is a cross-sectional view, taken along line "VI-VI" of FIG. 4.
Figure 7:
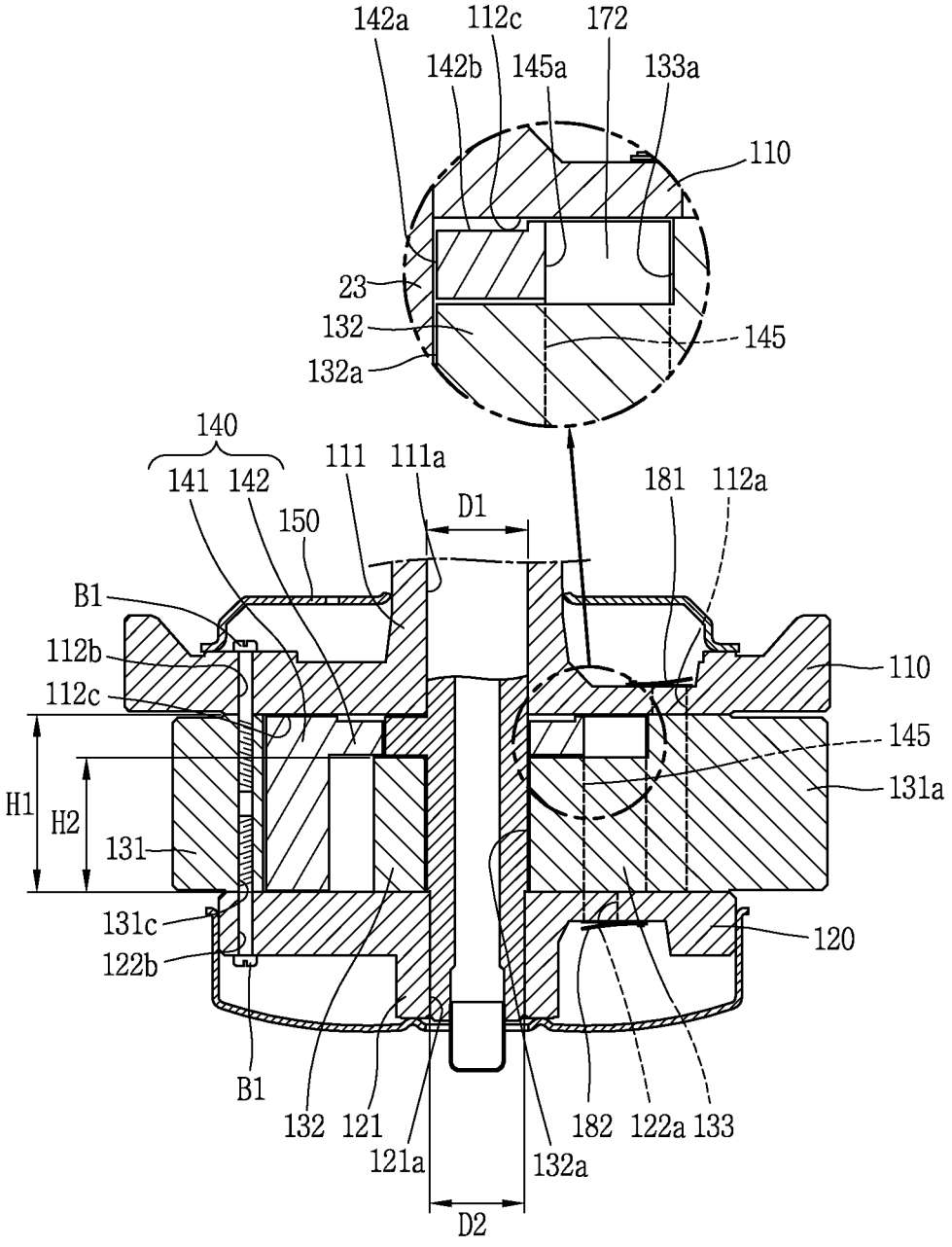
FIG. 7 is a longitudinal cross-sectional view of the compression device, taken along line "VII-VII" of FIG. 6.
Figure 8:
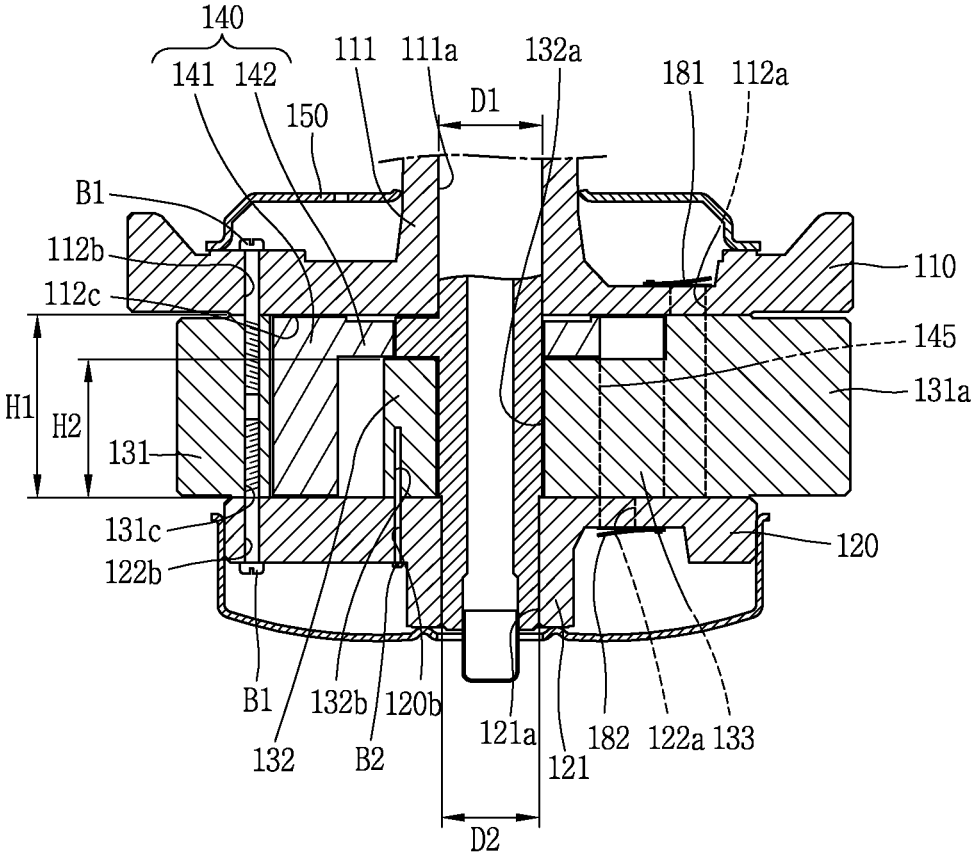
FIGS. 8 and 9 are a longitudinal cross-sectional view and a plan view of fastening structure of a cylinder in the compressor of FIG. 4.
Figure 9:
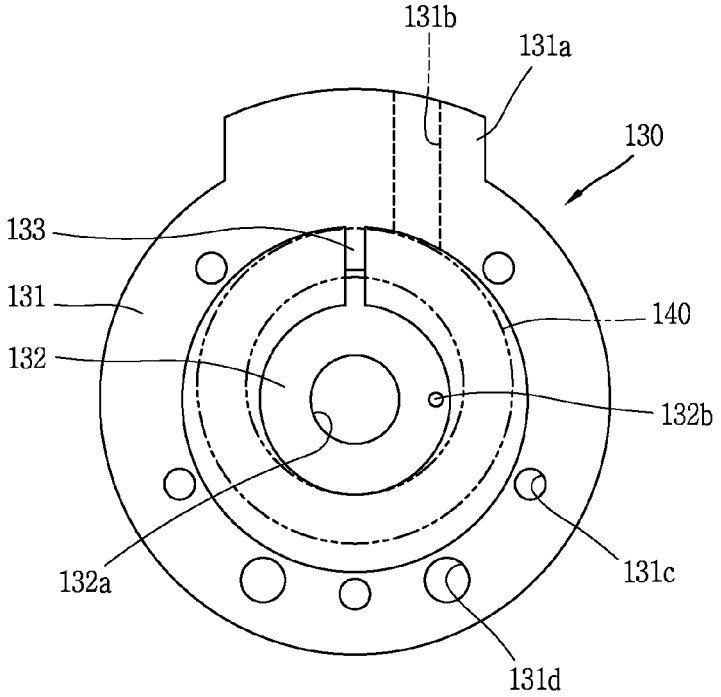

FIG. 4 is a longitudinal cross-sectional view of a 1-cylinder, 2-compression chamber type rotary compressor according to an embodiment, FIG. 5 is an exploded perspective view of a compression device in the compressor of FIG. 4. FIG. 6 is a cross-sectional view, taken along line "VI-VI" of FIG. 4. FIG. 7 is a longitudinal cross-sectional view of the compression device, taken along line "VII-VII"

of FIG. 6. FIGS. 8 and 9 are a longitudinal cross-sectional view and a plan view illustrating fastening structure of a cylinder in the compressor of FIG. 4.

As illustrated in the drawings, according to a 1-cylinder, 2-compression chamber type rotary compressor in accordance with an embodiment, a motor drive 2 that generates a driving force may be provided in an inner space of casing 1, and a compression device 100 having two compression spaces (V1, V2) in one cylinder may be provided at a lower side of the motor drive 2.

The motor drive 2 may include a stator 21 fixed and installed on an inner circumferential surface of the casing 1, a rotor 22 rotatably inserted into an inner side of the 21, and a crank shaft 23 coupled to a center of the rotor 22 to transmit a rotational force to a rolling piston 140, which will be described hereinbelow. The stator 21 may be formed in such a manner that a lamination laminated with a ring-shaped steel plate is shrink-fitted to be fixed and coupled to the casing 1, and a coil (C) may be wound around the lamination. The rotor 22 may be formed in such a manner that a permanent magnet (not shown) is inserted into the lamination laminated with the ring-shaped steel plate. The crank shaft 23 may be formed in a rod shape having a predetermined length and formed with an eccentric portion 23*c* that eccentrically protrudes in a radial direction at a lower end portion thereof to which the rolling piston 140 may be eccentrically coupled.

The compression unit or device 100 may include an upper bearing plate (hereinafter, referred to as an "upper bearing") 110 and a lower bearing plate (hereinafter, referred to as an "lower bearing") 120 provided at predetermined intervals in an axial direction to support the crank shaft 23, a cylinder 130 provided between the upper bearing 110 and the lower bearing 120 to form a compression space (V), and the rolling piston 140 coupled to the crank shaft 23 to compress the refrigerant of the compression space (V) while making a turning movement in the cylinder 130. The upper bearing 110 may be adhered to an inner circumferential surface of the casing 1 in, for example, a welded and coupled manner, and the lower bearing 120 may be fastened to the upper bearing 110 along with the cylinder 130 by, for example, a bolt.

A first discharge port 112*a* that communicates with first compression space (V1), which will be described hereinbelow, may be formed on the upper bearing 110, and a second discharge port 122*a* that communicates with second compression space (V2), which will be described later, may be formed on the lower bearing 120. A discharge cover 150 may be coupled to the upper bearing 110 to accommodate the first discharge port 112*a*, and a lower chamber 160 may be coupled to the lower bearing 120 to accommodate the second discharge port 122*a*. A discharge passage (F) sequentially passing through the lower bearing 120, the cylinder 130, and the upper bearing 110 may be formed to communicate an inner space of the lower chamber 160 with an inner space of the discharge cover 150.

The upper bearing 110 and the lower bearing 120 may each be formed in a ring shape, and axle receiving portions 111, 121 having axle holes 111*a*, 121*a*, respectively, may be formed at a center thereof.

An inner diameter (D1) of the axle hole 111*a* of the upper bearing 110 may be formed to be greater than an inner diameter (D2) of the axle hole 121*a* of the lower bearing 120. In other words, the crank shaft 23 may be formed in such a manner that a diameter at a portion brought into contact with the upper bearing 110 may be greater than a diameter at a portion brought into contact with the lower bearing 120 so as to mostly support the upper bearing 110 close to a center of an eccentric load. Accordingly, the second discharge port 122*a* located at a relatively inner side between the first discharge port 112*a* and the second discharge port 122*a* may be formed on the lower bearing 120 not to intrude into the axle receiving portion 121 of the lower bearing 120.

If the rolling piston 140 is turned upside down such that a driving transmission portion 142 comes in contact with the lower bearing 120 and accordingly the first discharge port 112*a* is closer to the crankshaft 23 than the second discharge port 122*a* of the lower bearing 120, the first discharge port 112*a* may intrude into the axis receiving portion 111 of the upper bearing 110 having a relative large outer diameter, thereby lowering bearing strength of the axis receiving portion 111 of the upper bearing 110. By considering this, in order to compensate for the bearing strength as much as the intrusion of the first discharge port 112*a*, the axis receiving portion 111 of the upper bearing 110 should be lengthened, which may cause an increase a size of the compressor.

As illustrated in FIGS. 5 and 6, the cylinder 130 may include an outer cylinder portion 131 formed in a ring shape, an inner cylinder portion 132 disposed at a predetermined interval therefrom to form a compression space (V) at an inner side of the outer cylinder portion 131, and a vane portion 133 configured to divide the first compression space (V1) and the second compression space (V2) into a suction chamber and a compression chamber, respectively, while at the same time connecting the outer cylinder portion 131 and the inner cylinder portion 132 in a radial direction. The vane portion 133 may be formed between a first inlet port 131*b*, which will be described hereinbelow, and the first discharge port 112*a*.

An outer circumferential surface of the outer cylinder portion 131 may be pressed onto an inner circumferential surface of the casing 1 in, for example, a welded and coupled manner, but an outer diameter of the outer cylinder portion 131 may be formed to be less than an inner diameter of the casing 1 and fastened between the upper bearing 110 and the lower bearing 120 by, for example, a bolt (B1), thereby preventing thermal deformation of the cylinder 130. However, in order to adhere a portion of the outer cylinder portion 131 to the inner circumferential surface of the casing 1, a protruded fixing portion 131*a* thereof may be formed in a circular arc shape, and the first inlet port 131*b*, which may pass through the protruded fixing portion 131*a* in a radial direction to communicate with the first compression space (V1) may be formed thereon. Refrigerant suction pipe 11 connected to accumulator 5 may be inserted and coupled to the first inlet port 131*b*.

Further, an upper surface and a lower surface of the outer cylinder portion 131 may be adhered to the upper bearing 110 and the lower bearing 120, respectively, and a plurality of fastening holes 131*c* may be formed at regular intervals along a circumferential direction. Furthermore, a plurality of discharge guide holes 131*d* that form a discharge passage (F) may be formed between the plurality of fastening holes 131*c*.

An axle hole 132*a* may be formed in the inner cylinder portion 132 to which the crank shaft 23 may be rotatably coupled to a central portion thereof. A center of the inner cylinder portion 132 may be formed to correspond to a rotational center of the crank shaft 23.

The inner cylinder portion 132 may be formed in such a manner that a height (H2) thereof is lower than a height (H1) of the outer cylinder portion 131. In other words, a lower surface of the inner cylinder portion 132 may be formed in a same plane as a lower surface of the outer cylinder portion 131 to be brought into contact with the lower bearing 120, whereas an upper surface thereof may be formed with a height at which the drive transmission portion 142 of the rolling piston 140, which will be described hereinbelow, may be inserted between the upper bearing 110 and the upper surface thereof.

The cylinder 130 may be fastened to fastening hole 112*b* of the upper bearing 110 and fastening hole 122*b* of the lower bearing 120 through the fastening hole 131*c* formed on the outer cylinder portion 131 of the cylinder 130. However, as illustrated in FIGS. 8 and 9, a fastening groove 132*b* may be formed on the inner cylinder portion 132 so as to be fastened to another fastening hole 122*c* of the lower bearing 120 through a bolt (B2). As a result, it may be possible to prevent the inner cylinder portion 132 from being deformed by a pressure of refrigerant compressed in the second compression space (V2). In this case, a plurality of fastening grooves 132*b* may be formed along a circumferential direction of the inner cylinder portion 132, but when the vane portion 133 is located at the center as illustrated in FIG. 9, they may be formed at the inlet side having a relatively high tolerance margin. As a result, a friction loss with the rolling piston 140 may be reduced even when the deformation of the inner cylinder portion 132 is generated during a bolt fastening process to fix the inner cylinder portion 132, thereby minimizing performance of the compressor from being deteriorated.

As illustrated in FIGS. 5 through 7, the vane portion 133 may have a predetermined thickness to connect between an inner circumferential surface of the outer cylinder portion 131 and an outer circumferential surface of the inner cylinder portion 132, as described above, and formed in a vertically raised plate shape.

Further, a stepped portion 133*a* may be formed on an upper surface of the vane portion 133 in such a manner that the drive transmission portion 142 of the rolling piston 140, which will be described hereinbelow, may be placed on part of the inner cylinder portion 132 and the vane portion 133 in a covering manner. Accordingly, when a portion from the outer connecting end 133*b* to the stepped portion 133*a* is referred to as a first vane portion 135 and a portion from the inner connecting end 133*c* to the stepped portion 133*a* is referred to as a second vane portion 136, a height of the first vane portion 135 in an axial direction may be formed with the same height as a height (H1) of the outer cylinder portion 131 in the axial direction, and a height of the second vane portion 136 in the axial direction may be formed with the same height as a height (H2) of the inner cylinder portion 132 in the axial direction.

Figure 11:
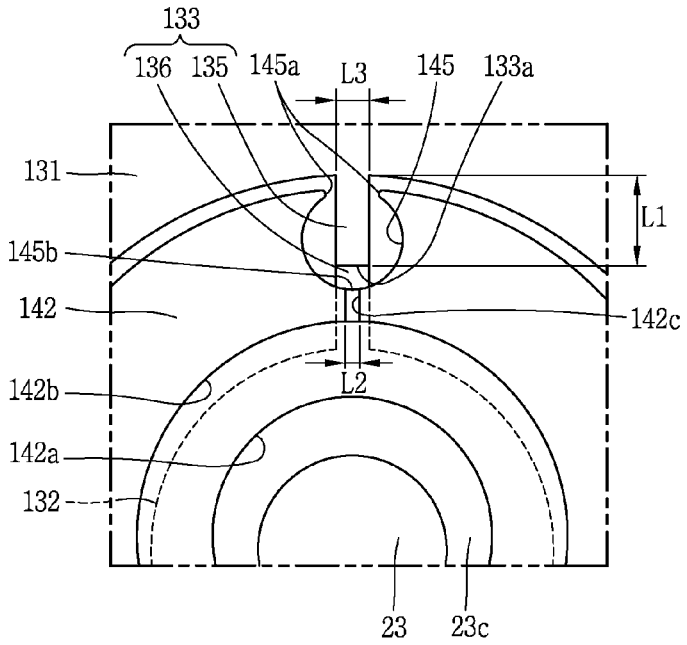
FIG. 11 is a plan view illustrating a standard of the oil passage in FIG. 10.
Figure 12:
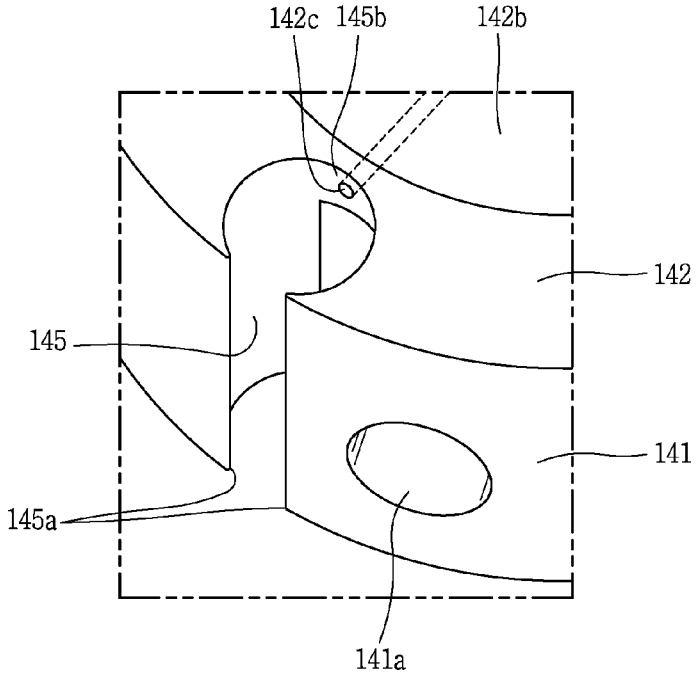
FIG. 12 is a plan view illustrating an oil passage according to another embodiment.

Further, as illustrated in FIG. 11, a length (L1) of the first vane portion 135 in a radial direction may be formed to be no greater than or substantially the same as an inner diameter of a bush groove 145 (or outer diameter of the rolling bush 170), which will be described hereinbelow, thereby preventing a gap from being generated between an inner circumferential surface of the outer cylinder portion 131 and an outer circumferential surface of the rolling piston 140 (or an outer circumferential surface of the rolling bush 170).

The rolling piston 140 may include a piston portion 141 disposed between the outer cylinder portion 131 and the inner cylinder portion 132, and a drive transmission portion 142 that extends from an upper end inner circumferential surface of the piston portion 141 and coupled to an eccentric portion 23*c* of the crank shaft 23 as illustrated in FIGS. 5 through 7.

The rolling piston 140 may include a piston portion 141 disposed between the outer cylinder portion 131 and the inner cylinder portion 132, and the drive transmission portion 142, which may extend from an upper end inner circumferential surface of the piston portion 141 and be coupled to the eccentric portion 23*c* of the crank shaft 23, as illustrated in FIGS. 5 through 7.

The piston portion 141 may be formed in a ring shape having a substantially rectangular cross section, and an outer diameter of the piston portion 141 may be formed to be less than an inner diameter of the outer cylinder portion 131 to form the first compression space (V1) at an outer side of the piston portion 141, and an inner diameter of the piston portion 141 may be formed to be greater than an outer diameter of the inner cylinder portion 132 to form the second compression space (V2) at an inner side of the piston portion 141. Further, a second inlet port 141*a* that passes through an inner circumferential surface of the piston portion 141 may be formed to communicate the first inlet port 131*b* with the second compression space (V2) may be formed, and the bush groove 145 may be formed between one side of the second inlet port 141*a*, namely, the second inlet port 141*a* and the second discharge port 122*a* formed on the lower bearing 120 in such a manner that the vane portion 133 passes through the rolling piston 140, which will be described hereinbelow, therebetween and is slidably inserted thereinto.

The bush groove 145 may be formed in a substantially circular shape, but an outer open surface 145*a* and an inner open surface 145*b* with a non-continuous surface on an outer circumferential surface and an inner circumferential surface of the piston portion 141 may be formed in such a manner that the vane portion 133 may pass through and be coupled to the bush groove 145 in a radial direction. The bush groove 145 may be formed in a substantially circular shape, but a portion thereof may be brought into contact with the outer circumferential surface and the inner circumferential surface of the piston portion 141 to have a non-continuous surface. The vane portion 133 may be inserted into the bush groove 145 in a radial direction, and an inlet side bush 171 and a discharge side bush 172 of rolling bush 170 may be inserted and rotatably coupled to both left and right sides of the vane portion 133, respectively. A flat surface of the rolling bush 170 may be slidably brought into contact with both lateral surfaces of the vane portion 133, respectively, and a round surface thereof may be slidably brought into contact with a main surface of the bush groove 145.

The drive transmission portion 142 may be formed as a ring-shaped plate shape having an eccentric portion hole 142*a* to be coupled to the eccentric portion 23*a* of the crank shaft 23. Further, a stepped back pressure groove 142*b* having a predetermined depth and area may be formed to form a back pressure space while at the same time reducing a friction area with a bearing surface of the upper bearing 110, around the eccentric portion hole 142*a* of the drive transmission portion 142, namely, on an upper surface of the drive transmission portion 142. Though not shown in the drawings, the back pressure groove may be formed on a bearing surface 112*c* of the upper bearing 110 in an axial direction.

Figure 10:
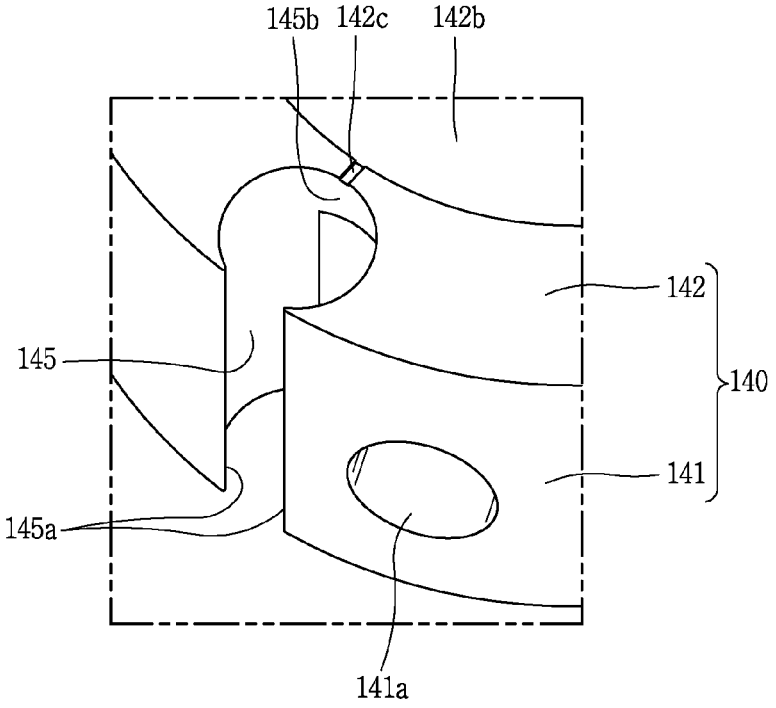
FIG. 10 is a perspective view of an oil passage that guides oil to a bush groove in the compressor of FIG. 4.

Further, as illustrated in FIGS. 10 and 11, an oil passage 142*c* connected to an inner circumferential surface of the bush groove 145 (or an outer circumferential surface of the piston portion 141) at the stepped groove 142*b* to guide a portion of the oil to flow into the stepped groove 142*b* or eccentric portion hole 142*a* between the bush groove 145 and the rolling bush 170 may be formed thereon. As a result, a portion of the oil sucked up through the crank shaft 23 and flowing into the stepped groove 142*b* around the eccentric portion hole 142*a* may flow into the bush groove 145 through the oil passage 142*c*, and the oil may lubricate between the bush groove 145 and the rolling bush 170 or between the rolling bush 170 and the vane portion 133, thereby reducing a friction loss between the rolling piston 140 and the rolling bush 170, as well as the vane portion 133 during the turning movement of the rolling piston 140.

As illustrated in FIG. 11, a width (L2) of the oil passage 142*c* may be formed not to be greater than a thickness (L3) of the vane portion 133. When the width (L2) of the oil passage 142*c* is greater than the thickness (L3) of the vane portion 133, a kind of surface discontinuity may be generated with respect to the rolling bush 170 during the turning movement of the rolling piston 140, thereby increasing abrasion or pressure. Accordingly, in order to minimize the surface discontinuity, the width (L2) of the oil passage 142*c* may be formed not to be greater than the thickness (L3) of the vane portion 133.

The oil passage 142*c* may be formed with a groove having a predetermined depth on an upper surface of the drive transmission portion 142, as illustrated in FIG. 10, but may be also formed as a hole that passes through the bush groove 145 on an inner circumferential surface of the eccentric portion hole 142*a*. Even in this case, the diameter of the oil passage 142*c* may be formed to be less than the thickness (L3) of the vane portion 133.

On the drawing, unexplained reference numerals 133*d* is sliding surface, 181 and 182 are first and second discharge valves, respectively.

Operation of a 1-cylinder, 2-compression chamber type rotary compressor having the foregoing configuration according to embodiments will be described as follows.

Figure 13A:
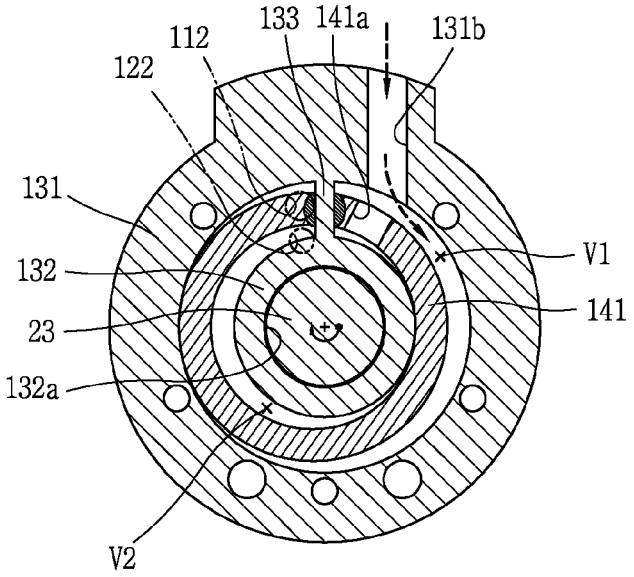
FIGS. 13A-13D are transverse cross-sectional views illustrating a compression process of an outer compression space and an inner compression space in the compressor according to embodiments.
Figure 13B:
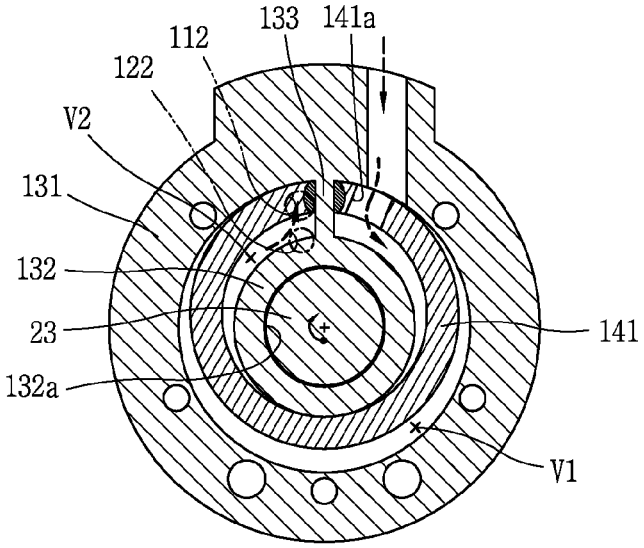
Figure 13C:
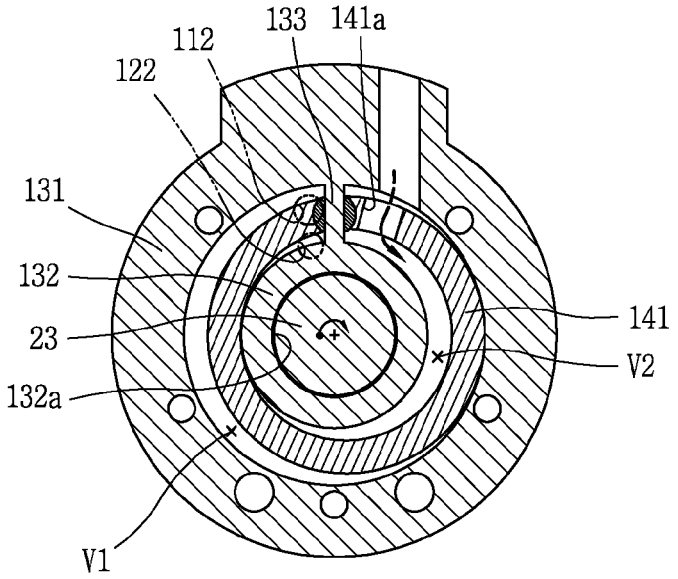
Figure 13D:
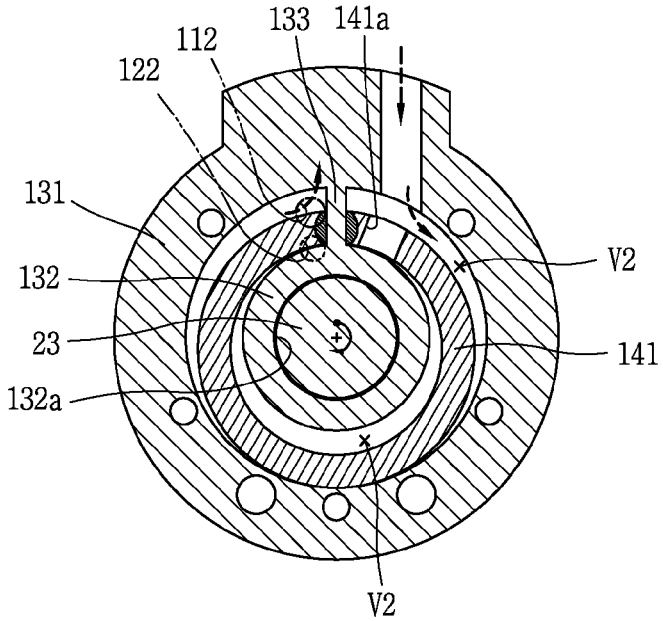

When power is applied to coil (C) of the motor drive 2 to rotate the rotor 22 along with the crank shaft 23, the rolling piston 140 coupled to the eccentric portion 23*c* of the crank shaft 23 may be supported by the upper bearing 110 and the lower bearing 120 and at the same time guided by the vane portion 133 to alternately form the first compression space (V1) and the second compression space (V2) while making a turning movement between the outer cylinder portion 131 and the inner cylinder portion 132. More specifically, when the rolling piston 140 allows the first inlet port 131*b* of the outer cylinder portion 131 to be open, refrigerant may be inhaled into the suction chamber of the first compression space (V1) and compressed while being moved in the direction of the compression chamber of the first compression space (V1) by the turning movement of the rolling piston 140, as illustrated in FIGS. 13A and 13B, and the refrigerant allows the first discharge valve 181 to be open and is discharged into an inner space of the discharge cover 150 through the first discharge port 112*a*, as illustrated in FIGS. 13C and 13D. At this time, an upper surface of the vane portion 133 is formed in a stepped manner, but the suction chamber and the compression chamber of the second compression space (V2) may be blocked by the rolling bush 170, thereby preventing leakage of refrigerant.

In contrast, when the rolling piston 140 allows the second inlet port 141*a* to be open, refrigerant is inhaled into the suction chamber of the second compression space (V2) through the first inlet port 131*b* and the second inlet port 141*a* and is compressed while being moved in the direction of the compression chamber of the second compression space (V2) by the rolling piston 140, as illustrated in FIGS. 13C and 13D, and the refrigerant allows the second discharge valve 182 to be open and is discharged into the lower chamber 160 through the second discharge port 122*a*, and the refrigerant is moved to an inner space of the discharge cover 150 through the discharge passage (F) and exhausted into an inner space of the casing 1, as illustrated in FIGS. 13A and 13B, so as to repeat a series of processes.

According to a 1-cylinder, 2-compression chamber type rotary compressor having the foregoing configuration in accordance with embodiments, the cylinder 130 may be fixed and the rolling piston 140 may perform a turning movement at an inner side of the cylinder 130, and thus, it may be possible to obtain a low power loss with respect to the same cooling power and a small bearing area compared to the rotating movement of a relatively heavy and large cylinder, thereby reducing concerns of refrigerant leakage. Further, according to embodiments, the cylinder 130 may be fixed and the rolling piston 140 may make a turning movement whereas the protruded fixing portion 131*a* may be formed at one side on an outer circumferential surface of the outer cylinder portion 131 to form a free space (S) between an inner circumferential surface of the casing 1 and an outer circumferential surface of the cylinder 130, and thus, a diameter of the cylinder 130 may be increased using the free space (S), thereby easily changing a capacity of the cylinder 130 in an expanded manner.

Furthermore, according to embodiments, the first discharge port 112*a* and the second discharge port 122*a* may be formed in opposite directions to each other, and thus, refrigerant being discharged may be absorbed with each other to reduce a pulsation phenomenon, thereby reducing vibration noise of the compressor.

In this manner, according to a 1-cylinder, 2-compression chamber type rotary compressor in accordance with embodiments, a cylinder having an outer cylinder portion and an inner cylinder portion may be fixed, and a rolling piston may perform a turning movement at an inner side of the cylinder, and thus, it may be possible to obtain a low power loss with respect to the same cooling power and a small bearing area compared to the rotating movement of a relatively heavy and large cylinder, thereby reducing concerns of refrigerant leakage. Further, the cylinder may be fixed and the rolling piston may make a turning movement whereas the protruded fixing portion may be formed at one side on an outer circumferential surface of the outer cylinder portion to form a free space between an inner circumferential surface of the casing and an outer circumferential surface of the cylinder, and thus, the diameter of the cylinder may be increased using the free space, thereby easily changing the capacity of the cylinder in an expanded manner.

Further, the first discharge port, which communicates with the outer compression space, and the second discharge port, which communicates with the inner compression space, may be formed in opposite directions to each other and thus refrigerant being discharged may be absorbed with each other to reduce a pulsation phenomenon, thereby reducing the vibration noise of the compressor.

Figure 14:
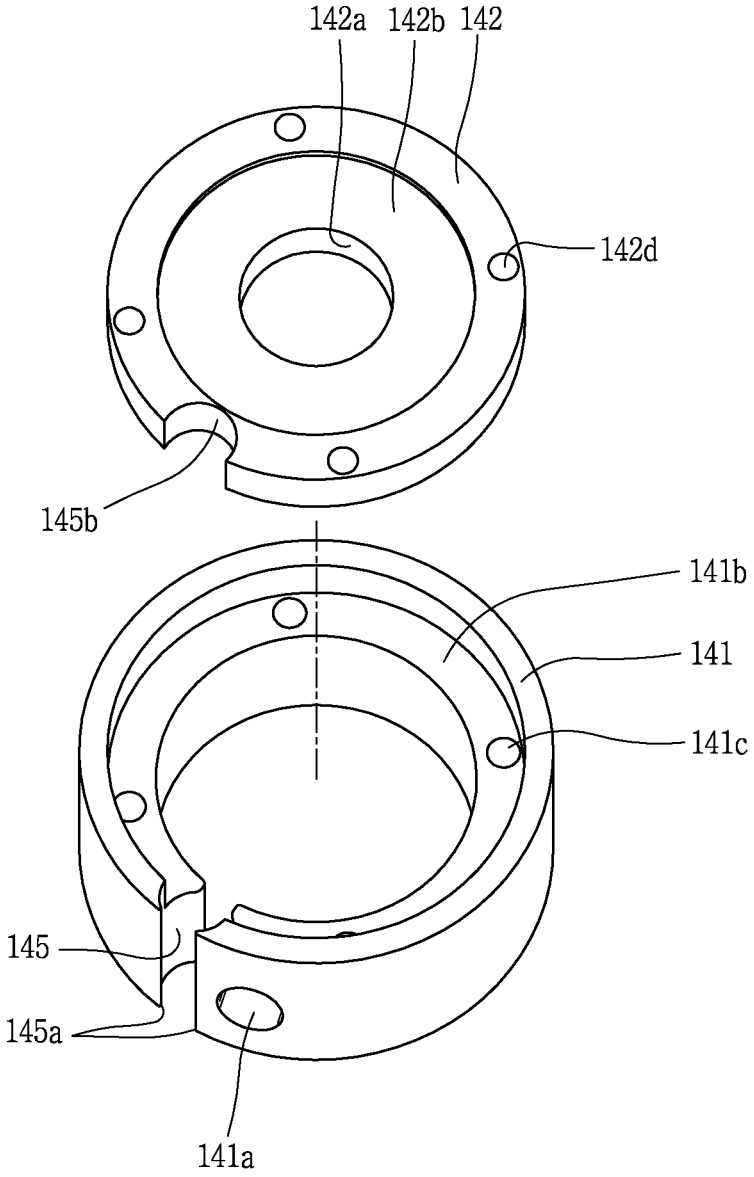
FIG. 14 is a perspective view of a rolling piston in a compressor according to another embodiment.
Figure 15:
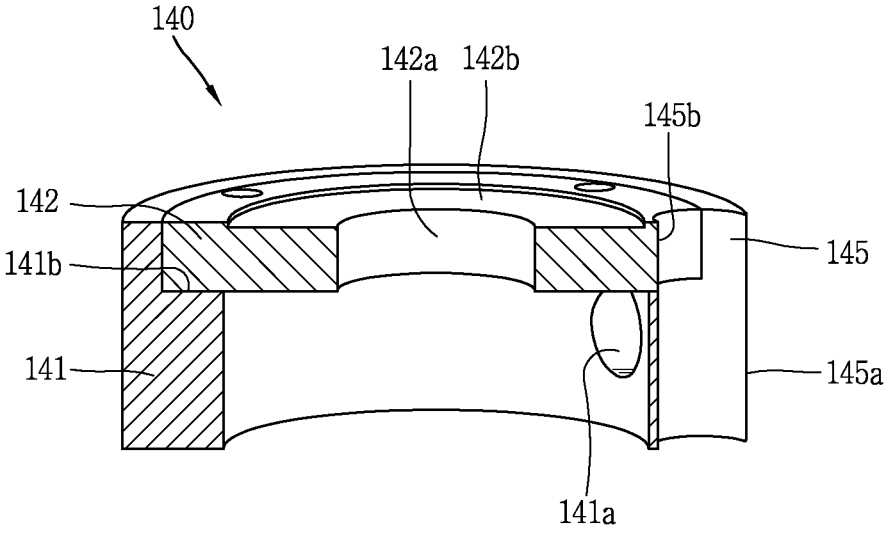
FIG. 15 is a perspective view of the rolling piston of FIG. 14.

A 1-cylinder, 2-compression chamber type rotary compressor according to another embodiment will be described hereinbelow. According to the previous embodiment, the drive transmission portion 142 of the rolling piston 140 may be integrally formed with the piston portion 141, but according to this embodiment, the piston portion 141 and the drive transmission portion 142 may be fabricated in a separate manner and then fastened with, for example, a bolt, as illustrated in FIGS. 14 and 15. In this case, an outer diameter of the piston portion 141 may be formed to be the same as an outer diameter of the drive transmission portion 142, and thus, the drive transmission portion 142 may be placed on an upper surface of the piston portion 141 so as to be fastened with, for example, a bolt, but as illustrated in FIGS. 14 and 15, a ring-shaped mounting groove 141*b* may be formed in a stepped manner into which the drive transmission portion 142 may be inserted and placed on an upper surface of the piston portion 141. Reference numerals 141*c* and 142*d* denote a fastening groove and a fastening hole, respectively. Even in this case, the second inlet port 141*a* and bush groove 145 may be formed on the piston portion 141 with the same standard as the previous embodiment.

The basic configuration and working effects thereof for a 1-cylinder, 2-compression chamber type rotary compressor having a rolling piston according to embodiments may be substantially the same as the previous embodiments, and thus, detailed description thereof has been omitted. However, according to this embodiment, the piston portion and drive transmission portion of the rolling piston may be separately fabricated and assembled, and thus, fabrication of the rolling piston may be relatively facilitated, as well as friction loss and leakage loss due to machining error may be suppressed, thereby enhancing performance of the compressor.

Figure 16:
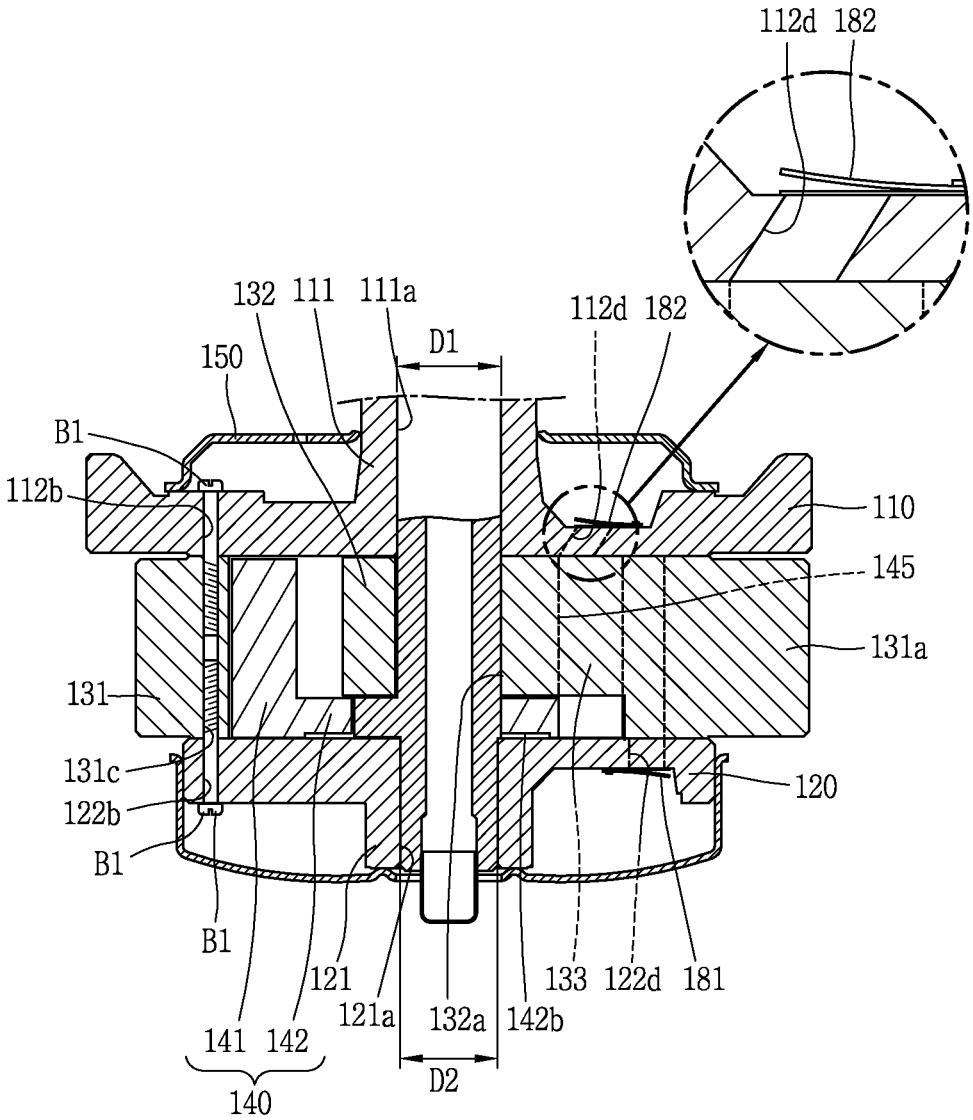
FIG. 16 is a longitudinal cross-sectional view of a rolling piston and in a compressor according to another embodiment.

On the other hand, a 1-cylinder, 2-compression chamber type rotary compressor having the foregoing configuration according to still another embodiment will be described hereinbelow. According to this embodiment, the drive transmission portion of the rolling piston may be formed to extend from an upper end of the piston portion, but according to this embodiment, as illustrated in FIG. 16, the drive transmission portion 142 of the rolling piston 140 may be formed to extend from a lower end of the piston portion 141. The basic configuration and working effects thereof according to this embodiment may be substantially the same as the foregoing embodiments.

However, according to this embodiment, the drive transmission portion 142 may be formed to extend from a lower end of the piston portion 141, and thus, a first discharge port 122*d* may be formed on the lower bearing 120, and a second discharge port 112*d* on the upper bearing 110, respectively. Further, in this case, when the second discharge port 112*d* is formed in a vertical direction, the second discharge port 112*d* may interfere with an outer circumferential surface of the axle receiving portion 111 of the upper bearing 110 to intrude into part of the outer circumferential surface of the axle receiving portion 111 of the upper bearing 110, and thus, as illustrated in FIG. 16, the second discharge port 112*d* may be formed to be inclined out from the axle receiving portion 111 of the upper bearing 110.

According to a 1-cylinder, 2-compression chamber type rotary compressor having the foregoing embodiment, the drive transmission portion 142 may be formed at a lower end of the piston portion 141, thereby reducing a friction loss between the rolling piston 140 and the lower bearing 120. In other words, as illustrated in the previous embodiment, when the drive transmission portion 142 is formed to extend from an upper end of the piston portion 141, a lower surface of the piston portion 141 may receive an entire weight of the rolling piston 140, but the lower surface of the piston portion 141 should secure an adequate sealing area and as a result, a stepped groove cannot be formed on a lower surface of the piston portion 141.

Accordingly, in the previous embodiments, it may be difficult to reduce a friction loss between the lower surface of the piston portion 141 and the lower bearing 120, but as illustrated in the foregoing embodiment, when the drive transmission portion 142 is formed at a lower end of the piston portion 141, the stepped groove 142*b* may be formed on a lower surface of the drive transmission portion 142, thereby reducing friction loss while the rolling piston 140 rises by a back pressure of oil that flows into the stepped groove 142*b* without increasing a friction area.

Embodiments disclosed herein provide a compressor having a low power loss with respect to the same cooling power and a small bearing area capable of reducing a weight of a rotating body, thereby reducing refrigerant leakage.

Embodiments disclosed herein further provide a compressor capable of easily changing a capacity of a cylinder in an expanded manner.

Embodiments disclosed herein also provide a compressor in which refrigerant discharged from each compression space is absorbed with each other to reduce a pulsation phenomenon, thereby reducing vibration noise.

Embodiments disclosed herein provide a compressor that may include a casing; a crank shaft configured to transmit a rotational force of a motor drive provided within the casing; a plurality of bearing plates configured to support the crank shaft; a cylinder fixed and coupled between the bearing plates to form a compression space; and a rolling piston eccentrically coupled to the crank shaft to divide the compression space into an outer compression space and an inner compression space while making a turning movement with respect to the cylinder. The cylinder may include an outer cylinder portion; an inner cylinder portion separated from an inner side of the outer cylinder portion by a predetermined distance to form a compression space; and a vane portion configured to connect between an inner circumferential surface of the outer cylinder portion and an outer circumferential surface of the inner cylinder portion, to which the rolling piston is slidably inserted and coupled.

Further, embodiments disclosed herein provide a compressor that may include a cylinder having an outer cylinder portion and an inner cylinder portion formed in a ring shape with a predetermined distance in a radial direction, and a vane portion that connects between the outer cylinder portion and inner cylinder portion; and a rolling piston having a piston portion slidably coupled to the vane portion between the outer cylinder portion and inner cylinder portion to divide a compression space between the outer cylinder portion and inner cylinder portion into an outer compression space and an inner compression space, and a drive transmission portion extended from the piston portion and eccentrically coupled with respect to an axial center of the crank shaft. A height of the inner cylinder portion may be formed to be less than that of the outer cylinder portion to cover one lateral surface thereof by the drive transmission portion of the rolling piston.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

a crank shaft configured to transmit a rotational force of a motor drive provided within the casing to a rolling piston;

a plurality of bearing plates configured to support the crank shaft;

a cylinder fixed and coupled between the plurality of bearing plates to form a compression space; and the rolling piston, which is eccentrically coupled to the crank shaft to divide the compression space into an outer compression space and an inner compression space while making a turning movement with respect to the cylinder, wherein the cylinder includes:

an outer cylinder portion;

an inner cylinder portion separated from an inner side of the outer cylinder portion by a predetermined distance to form the compression space; and a vane portion that connects an inner circumferential surface of the outer cylinder portion and an outer circumferential surface of the inner cylinder portion, to which the rolling piston is slidably inserted and coupled, wherein the vane portion is formed with an outer connecting end connected to the inner circumferential surface of the outer cylinder portion and an inner connecting end connected to the outer circumferential surface of the inner cylinder portion and wherein a stepped portion is formed between an upper surface of the outer connecting end and an upper surface of the inner connecting end, wherein the rolling piston is formed with a bush groove into which the vane portion of the cylinder is slidably inserted, wherein a rolling bush that guides the turning movement of the rolling piston is rotatably coupled to the bush groove, and wherein an inner diameter of the bush groove is formed to be equal to or greater than a length from the outer connecting end of the vane portion to the stepped portion.

2. The compressor of claim 1, wherein an oil passage that guides oil to the bush groove communicates with the bush groove.

3. The compressor of claim 2, wherein a width of the oil passage is less than or equal to a thickness of the vane portion.

4. The compressor of claim 3, wherein the oil passage includes a groove formed in an upper surface of the rolling piston.

5. The compressor of claim 3, wherein the oil passage includes a hole formed through the rolling piston.

6. The compressor of claim 1, wherein the rolling piston includes:

a piston portion disposed between the outer cylinder portion and the inner cylinder portion; and a drive transmission portion that integrally extends from an upper end or a lower end of the piston portion and is coupled to an eccentric portion of the crank shaft.

7. The compressor of claim 6, wherein a stepped groove is formed on a lateral surface of the drive transmission portion or a bearing surface of one of the plurality of bearing plates, the stepped groove functioning as a bearing surface with respect to the one of the plurality of bearing plates in an axial direction or as a bearing surface with respect to the lateral surface of the drive transmission portion in the axial direction, respectively.

8. The compressor of claim 1, wherein the rolling piston includes:

a piston portion disposed between the outer cylinder portion and the inner cylinder portion; and a drive transmission portion fastened to an upper end or a lower end of the piston portion and coupled to an eccentric portion of the crank shaft, and wherein a mounting groove into which the drive transmission portion is inserted and fastened is formed on the piston portion.

9. The compressor of claim 8, wherein a stepped groove is formed on a lateral surface of the drive transmission portion or a bearing surface of one of the plurality of bearing plates, the stepped groove functioning as a beating surface with respect to the one of the plurality of bearing plates in an axial direction or as a bearing surface with respect to the lateral surface of the drive transmission portion in the axial direction.

10. The compressor of claim 1, wherein at least one of the plurality of bearing plates is fixed and coupled to the casing, and wherein the outer cylinder portion is fastened to each of the plurality of bearing plates.

11. The compressor of claim 10, wherein the inner cylinder portion is fastened to one of the plurality of bearing plates.

12. The compressor of claim 10, wherein a protruded fixing portion is formed in a circular arc shape at one side on an outer circumferential surface of the outer cylinder portion, and wherein a portion at which the protruded fixing portion is not formed is separated from an inner circumferential surface of the casing by a predetermined distance.

13. The compressor of claim 12, wherein a first inlet port that passes through from the outer circumferential surface to the inner circumferential surface of the outer cylinder portion to communicate with the outer compression space is formed in the protruded fixing portion, and wherein a second inlet port that passes through from the outer circumferential surface to the inner circumferential surface of the rolling piston to communicate with the inner compression space is formed in the rolling piston.

14. The compressor of claim 1, wherein a first discharge port that communicates with the outer compression space is formed on one of the plurality of bearing plates, and a second discharge port that communicates with the inner compression space is formed on another of the plurality of bearing plates.

15. A compressor, comprising;

a cylinder having an outer cylinder portion and an inner cylinder portion each formed in a ring shape with a predetermined distance therebetween in a radial direction, and a vane portion that connects the outer cylinder portion and the inner cylinder portion; and a rolling piston including a piston portion slidably coupled to the vane portion between the outer cylinder portion and inner cylinder portion to divide a compression space between the outer cylinder portion and the inner cylinder portion into an outer compression space and an inner compression space, and a drive transmission portion that extends from the piston portion and is eccentrically coupled with respect to an axial center of a crank shaft, wherein a height of the inner cylinder portion is formed to be less than a height of the outer cylinder portion, wherein a lateral surface of the inner cylinder portion is at least partially covered by the drive transmission portion of the rolling piston, wherein the vane portion includes:

a first vane portion configured to divide a suction chamber and a compression chamber of the outer compression space; and a second vane portion configured to divide a suction chamber and a compression chamber of the inner compression space, and wherein a height of the first vane portion is formed to be the same as a height of the outer cylinder portion, and a height of the second vane portion is formed to be the same as a height of the inner cylinder portion.

16. The compressor of claim 15, wherein the vane portion is formed with an outer connecting end connected to an inner circumferential surface of the outer cylinder portion and an inner connecting end connected to an outer circumferential surface of the inner cylinder portion, and wherein a stepped portion is formed between an upper surface of the outer connecting end and an upper surface of the inner connecting end.

17. The compressor of claim 16, wherein the rolling piston is formed with a bush groove into which the vane portion of the cylinder is slidably inserted, wherein a rolling bush that guides a turning movement of the rolling piston is rotatably coupled to the bush groove, and wherein an inner diameter of the bush groove is formed to be equal to or greater than a length from the outer connecting end of the vane portion to the stepped portion.

* * * * *